United States Patent [19]

Ruder

[11] Patent Number: 4,967,207

[45] Date of Patent: Oct. 30, 1990

[54] INK JET PRINTER WITH SELF-REGULATING REFILLING SYSTEM

[75] Inventor: James L. Ruder, Escondido, Calif.

[73] Assignee: Hewlett-Packard Company, Palo Alto, Calif.

[21] Appl. No.: 385,760

[22] Filed: Jul. 26, 1989

[51] Int. Cl.[5] ..... B41J 2/175

[52] U.S. Cl. ..... 346/140 R

[58] Field of Search ..... 346/75, 140

[56] References Cited

U.S. PATENT DOCUMENTS 4,187,511 2/1980 Robinson ..... 346/75

4,714,937 12/1987 Kaplinsky ..... 346/140 PD

OTHER PUBLICATIONS

"Recharging your Deskjet Cartridges", Larry Rymal, The Journal of the San Diego Computer Society, May 1989, p. 16.

"Ink Retention in a Color Thermal Inkjet Pen", Erol Ertuk et al., Hewlett-Packard Journal, Aug. 1988, pp. 41–44.

*Primary Examiner*—George H. Miller, Jr.

[57] ABSTRACT

An ink jet printer (30) includes a print head reservoir container (14) having a colorant refill needle (26) extending from the exterior to the interior thereof and a vacuum port (24) therein, and a service station (50) having a valve (52) that controllably connects the refill needle (26) to a colorant supply (56) and controllably connects the vacuum port (24) to a vacuum manifold (60). Colorant is added to the reservoir container (14) by first drawing a vacuum on the interior of the reservoir container (14) with the vacuum manifold (60) connected to the vacuum port (24) and with the refill needle (26) sealed, and then sealing the vacuum port (24), placing the refill needle (26) in communication with the exterior colorant supply (56), and permitting the partial vacuum in the interior of the reservoir container (14) to draw colorant from the colorant supply (56) into the interior of the reservoir container (14).

20 Claims, 3 Drawing Sheets

INK JET PRINTER WITH SELF-REGULATING REFILLING SYSTEM

BACKGROUND OF THE INVENTION

This invention relates to ink jet printers, and, more particularly, to a printer wherein the colorant reservoir on the print head may be refilled during normal operation.

Printers are devices that print characters onto a printing medium such as a sheet of paper or a polyester film. Printers of many types are available, and are commonly controlled by a computer that supplies the images, in the form of text or figures, that are to be printed.

Some printers use a colorant-containing liquid, which may be an ink or a dye, but is often termed an "ink" or "liquid toner" in the printer industry, to form the images on the printing medium. (By contrast, other printers use a dry toner to form the image.) Such printers deliver the colorant to the medium using a print head that creates the proper patterning of colorant to permanently record the image.

One type of printer is the ink jet printer, which forms small droplets of colorant that are ejected toward the printing medium in a pattern of dots that form the images. When viewed at a distance, the collection of dots form the image in much the same manner that photographic images are formed in newspapers. Ink jet printers are fast, produce high quality printing, and are quiet, because there is no mechanical impact during formation of the image, other than the droplets of colorant striking the printing medium.

Typically, an ink jet printer has a large number of individual colorant-ejection nozzles in the print head, supported in a carriage and oriented in a facing, but spaced-apart, relationship to the printing medium. The carriage and supported print head traverse over the surface of the medium, with the nozzles ejecting droplets of colorant at appropriate times under command of the computer or other controller, to produce a swath of droplets. In the thermal ink jet printer, the ejection of droplets is accomplished by heating a volume of the colorant adjacent the nozzle with a resistor, thereby vaporizing a bubble of the colorant to drive the droplet toward the printing medium. The droplets strike the medium and then dry to form "dots" that, when viewed together, form one swath or row of the permanently printed image. The carriage is moved an increment in the direction lateral to the traverse (or, alternatively, the printing medium is advanced), and the carriage again traverses the page with the print head operating to deposit another swath. In this manner, the entire pattern of dots that form the image is progressively deposited by the print head during a number of traverses of the page. To achieve the maximum output rate, the printing is preferably bidirectional, with the print head ejecting colorant during traverses from left-to-right and right-to-left.

The colorant is stored in a reservoir that, for some types of printers, is mounted on the carriage adjacent the nozzles. Colorant is then delivered by capillary action to the nozzles for ejection. It is common for some printers that the print head is a single consumable and disposable unit, that may be readily inserted and removed from the printer when the colorant in the reservoir is exhausted or one or more of the nozzles malfunction.

In the early stages of the development of thermal ink jet printers, the useful life of the print head was usually established by the time until a nozzle failure occured. In some cases the colorant ejector system would become inoperable prior to depletion of the colorant in the reservoir. More recently, the design and manufacturing of the nozzles and associated apparatus of the print head have advanced, so that the life of the nozzles prior to failure is lengthened significantly. Thus, the reservoir's supply of colorant may be exhausted before nozzle failures are experienced. There now exists a need for a larger supply of colorant available for ejection.

The design of the reservoir container of the print head is sophisticated, because it is initially filled with colorant and transported to the customer, and thereafter must deliver a flow of filtered colorant without leakage under a variety of conditions such as different orientations of the print head and use of the printer at different altitudes and temperatures. In one present approach, the interior of the reservoir container contains a compliant open cell foam. Colorant is filled into the foam during manufacture. The colorant is retained within the pores of the foam, and slowly flows to the ejector over the life of the print head. Filling of the reservoir container requires great care to avoid pockets of colorant that can leak, air pockets, and defects in the foam that cause irregular colorant flow.

Simply increasing the size of the reservoir container is not an acceptable solution to the problem of providing a larger colorant supply, because the container is supported upon the printer carriage and moves with the nozzle mechanism. Increasing the size of the reservoir container would necessarily increase the size, strength, and cost of the structure that supports and moves the carriage. The performance of the printer would suffer, because of the greater mass of the carriage and container.

There is a need for an approach for increasing the amount of colorant available for droplet ejection in such a print head. The approach should permit the desirable features of the present approach to providing colorant to be retained, provide more colorant, and not unduly increase the cost or complexity of the printer. The present invention fulfills this need, and further provides related advantages.

SUMMARY OF THE INVENTION

The present invention provides a printer, print head, and approach for their operation that substantially increase the colorant supply available for ejection by the print head. The well established design of the currently used colorant reservoir is largely retained in a modified form. Complex instrumentation for monitoring the colorant level in the reservoir container is not required. It is not possible to overfill the container using the approach of the invention, even though such instrumentation is not present.

With the present approach, after the reservoir container is partially depleted of colorant, it is refilled at a service station location of the printer. To accomplish the refilling, a partial vacuum is drawn within the container. The vacuum port is sealed, and the interior of the container is connected to a larger colorant supply exterior to the container, and typically mounted on the frame of the printer. Colorant is drawn into the container through a refill means by the partial vacuum, until the pressure within the container and at the colorant supply are equalized or nearly equalized. It is impossible to overfill the reservoir container with this refilling approach, because the only force drawing colorant into the container is the partial vacuum, which decreases and approaches zero as the colorant flows into the container. It is therefore not necessary to provide complex metering and measurement instrumentation that would otherwise be required to avoid overfilling. This approach also results in the proper pressurization conditions inside the container for a smooth and immediate flow of colorant into the ejector portion of the print head.

The invention therefore extends to a printer, a print head, and a method of accomplishing the filling operation. In accordance with the first aspect of the invention, an ink jet printer comprises print head means for ejecting droplets of a colorant, including a reservoir container that holds a volume of the colorant, a colorant ejector in communication with the reservoir container that receives a flow of colorant from the reservoir container and ejects droplets of colorant therefrom under command, a vacuum port in the wall of the reservoir container, and refill tube means for refilling the reservoir, the refill tube means communicating from the exterior of the reservoir container into the interior of the reservoir container; and a service station for adding colorant to the reservoir container, including a colorant supply, a vacuum manifold, valve means for controllably placing the colorant supply in communication with the refill tube means and sealing the colorant supply from the refill tube means, and for controllably placing the vacuum manifold in communication with the vacuum port and sealing the vacuum manifold from communication with the vacuum port, and support means for holding the reservoir container in contact with the valve means, for preventing ejection of colorant, and for preventing introduction of air into the print head.

The printer mechanism, apart from the print head, is also unique. In accordance with this aspect of the invention, an ink jet printer is operable with print head means for ejecting droplets of a colorant, the print head means including a reservoir container that holds a volume of the colorant, an ink ejector that receives colorant from the reservoir container and ejects droplets of colorant therefrom, and a refill tube or needle that extends from the exterior of the reservoir container into the interior of the reservoir container. The printer comprises a service station whereat colorant is added to the reservoir container, including a colorant supply, a vacuum manifold, valve means for controllably placing the colorant supply in communication with the refill tube and sealing the colorant supply from the refill tube, and for controllably placing the vacuum manifold in communication with the interior of the reservoir container and sealing the vacuum manifold from the reservoir container, and support means for holding the reservoir container in contact with the valve means, for preventing ejection of colorant, and for preventing introduction of air into the print head. The support seals the nozzles to prevent air from being drawn therein while the interior of the reservoir container has a vacuum drawn thereon.

Further in accordance with the invention, a thermal ink jet print head comprises a reservoir container having a foam mass therein and adapted for holding a supply of the colorant; an ink ejector that receives colorant from the reservoir container and ejects colorant therefrom; a vacuum port in the wall of the reservoir container; and a refill tube (alternately termed a refill needle) inserted from the exterior of the reservoir container into the foam mass within the reservoir container.

The invention also extends to the process for adding colorant to the print head of a thermal ink jet printer, comprising the steps of furnishing a colorant reservoir container; creating a partial vacuum in the interior of the reservoir container using a vacuum manifold; and sealing the interior of the reservoir container from the vacuum manifold and permitting colorant to be drawn into the interior of the reservoir container by the partial vacuum created in the step of creating.

In the preferred approach, the reservoir container contains an open-pore foam that retains the colorant and prevents leakage. The refill tube in the form of a refill needle penetrates the top of the reservoir container into the interior of the foam. The needle is vented to the air during normal operation of the printer and print head. When colorant is to be added into the reservoir container during printer operation, the print head is moved to a service station position at one end of the traverse. A support holds the container in the proper position against a valve, and seals the nozzles to permit a vacuum to be drawn on the interior of the container. The valve closes the exterior end of the needle and simultaneously connects the vacuum port at the top of the reservoir container to a vacuum manifold that draws air out of the container to create a partial vacuum. After the vacuum is drawn, the valve is again operated to close the vacuum port and connect the exterior end of the needle to the exterior colorant supply, which typically might be a vented bottle of colorant fastened to the frame of the printer and connected to the valve by a piece of tubing. The partial vacuum draws colorant from the exterior colorant supply, through the needle, and into the foam within the reservoir container. As colorant flows into the reservoir container, it refills the reservoir container and reduces the gas space, thereby increasing the pressure and reducing the degree of vacuum. Ultimately, the gas pressure within the reservoir container approaches one atmosphere, and there is no further driving force to draw colorant into the reservoir container. The flow of colorant stops before the reservoir container can be overfilled. The valve operates to open both the needle and the vacuum port, the support is withdrawn, and the print head is again ready for printing.

This approach is fast and clean, with little likelihood of spillage of colorant or overfilling of the container. The amount of colorant refilled depends upon how much colorant has been removed from the reservoir container during prior printing. If there has been little demand and little colorant removed, there will be only a small amount of air drawn out by the vacuum manifold and only a small amount of colorant refilled from the colorant supply. Conversely, if there has been a high demand for colorant, then a large amount of colorant will be refilled into the container from the colorant supply. This self-regulating feature, where no measurements of liquid level or special instrumentation are required, is particularly desirable for printers that have multiple print heads, each producing droplets of different colors.

After refilling, the state within the reservoir container returns to essentially that when the reservoir container was first used, fresh from the factory, by the customer. It will be known from the size of the reservoir and the printing characteristics of its nozzles that the reservoir container holds sufficient colorant to print at least some fixed number of lines of print, a number that ordinarily will be at least several thousand lines. The refilling operation can be programmed to be undertaken within that number of lines, and preferably when page changes of the printing medium occur. Because the refilling operation is accomplished quickly, there is little if any interruption to the primary printing function of the printer.

Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
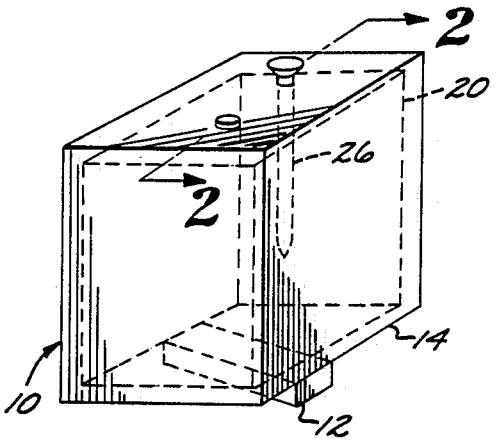
FIG. 1 is a perspective view of a thermal ink jet print head assembly, with a portion of the interior illustrated in phantom lines.
Figure 2:
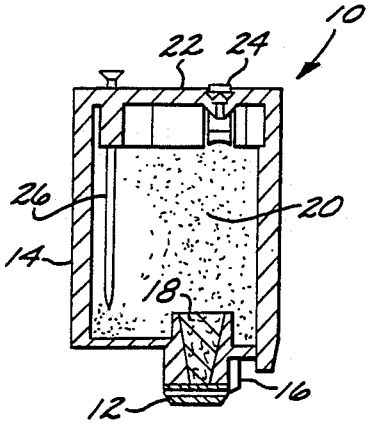
FIG. 2 is a side sectional view of the print head assembly of FIG. 1, taken generally along line 2—2.

The process of the present invention is preferably used in conjunction with a thermal ink jet printer, although it is not so restricted. A thermal ink jet printer utilizes a print head that creates and ejects microdroplets of colorant by vaporization of small bubbles of colorant. A thermal ink jet print assembly 10, used to eject droplets of colorant, such as an ink or a dye, toward a print medium in a precisely controlled manner, is illustrated in FIGS. 1 and 2. The general features of such a print assembly are discussed in more detail in U.S. Pat. No. 4,635,073, whose disclosure is incorporated by reference.

The print assembly 10 includes an ejector 12. The ejector includes a plurality of individual nozzles that eject colorant toward a printing medium. The construction and operation of the ejector 12 do not form a part of the present invention.

The ejector 12 is supported upon, and projects outwardly from, a reservoir container 14. The reservoir container 14 is a hollow rectangular structure having at the lower end and outlet 16 with a filter 18, through which colorant flows from the interior of the container 14 to the ejector 12.

The interior of the container 14 is partially filled with a generally conforming piece 20 of an open cell, reticulated foam. The foam piece 20 is preferably made of polyether polyurethane having 75 pores per inch and felted to three times original density. The foam piece 20 is made in the same general shape as the interior of the container 14, but slightly oversize. The foam piece 20 is therefore in a slight compression after it is inserted into the container 14. The compression, along with a high degree of care taken in inserting the foam piece 20 and filling it with colorant, avoids gas pockets within the container 14, after it is filled with colorant. At the factory, colorant is introduced under vacuum into the foam with a needle stuck into the interior of the foam piece 20, to fill the container 14 with colorant. Details of the factory filling operation can be found in the publication "Ink Retention in a Color thermal Inkjet Pen" by Erol Erturk, Brian D. Gragg, Mary E. Haviland, W. Wistar Rhoads, Jim L. Ruder, and Joseph E. Scheffelin, published in the Hewlett Packard Journal, Aug. 1988.

After colorant is introduced into the foam piece 20, a plug 22 is fitted to the body of the container 14, and ultrasonically welded in place. The plug has a vent therethrough, which functions as a vacuum port 24. The plug 22 also has a refill needle 26 therethrough, whose tip extends downwardly into the body of the foam piece 20. The needle 26 is preferably positioned so that its lower tip is near the bottom of the container 14, but not adjacent the filter 18 and ejector 12. The refill needle functions as a refill tube or refill tube means during refilling of the reservoir container 14, in a manner to be described.

Figure 3:
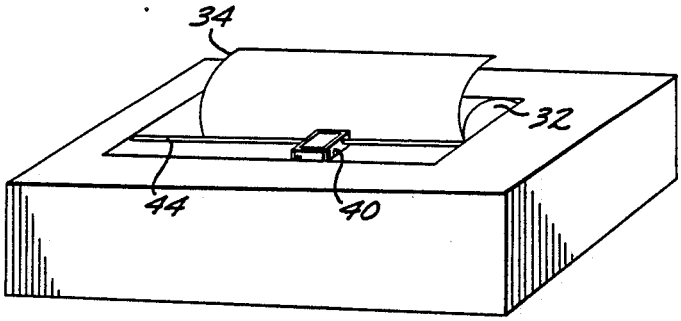
FIG. 3 is a perspective view of a thermal ink jet printer.

FIG. 3 illustrates in general view one type of ink jet printer 30 with which the print head assembly 10 may be used. Further detail of the printer 30 is provided in the plan view of FIG. 4. The printer 30 includes a cylindrical roller or platen 32 upon which a sheet of a printing medium 34 is supported. The platen 32 is rotatably driven by a stepping motor or DC servo motor 36 (see FIG. 4) that causes it to controllably rotate in either direction. Rotation of the platen 32 advances the printing medium in the selected direction.

Figure 4:
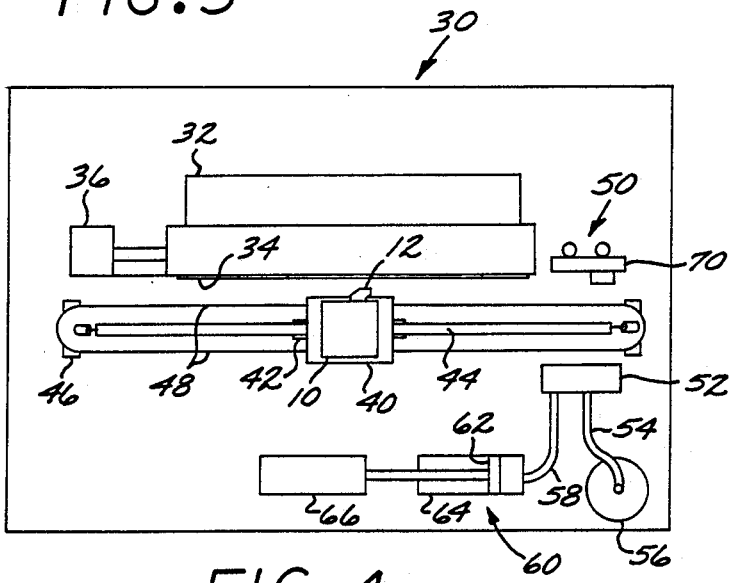
FIG. 4 is a schematic plan view of a portion of the ink jet printer of FIG. 3, with the cover removed to illustrate internal features.

A carriage 40, depicted in more detail in FIG. 4, is supported above the printing medium 34 on bearings 42 from a rail 44. The carriage 40 slides along the rail 44 under the control of a traversing motor 46 acting through a belt or cable 48 that extends from the motor 46 to the carriage 40.

The print head assembly 10 is supported in the carriage 40, in a generally facing but spaced apart relationship to the printing medium 34, so that colorant droplets ejected from the ejector 12 strike the printing medium 34. (Multiple print heads, or at least multiple ejectors 12, are needed where a variety of colors are to be printed, and such an approach is within the scope of the present invention.)

Figure 5:
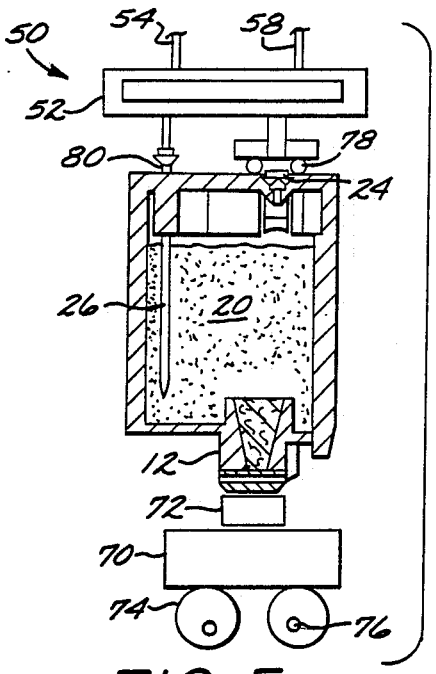
FIG. 5 is a side elevational view of the service station of FIG. 4, with the print head assembly illustrated in section.

At one extreme of carriage movement is a service station 50, whose structure and function can be understood more clearly by reference to FIG. 5. The service station 50 is positioned off the end of the printing medium 34, so that the carriage 40 and ejector 12 are not over the printing medium when they are within the service station 50. The service station 50 includes a valve 52. A colorant supply line 54 extends from the valve 52 to a colorant supply bottle 56 mounted to the frame of the printer 30. The bottle 56 contains a large volume of colorant, usually many times that of the colorant contained within the reservoir container 14.

Under appropriate conditions, colorant is transferred from the bottle 56 through the line 54 and through the valve 52, into the interior of the reservoir container 14.

A vacuum line 58 extends from another portion of the valve 52 to a vacuum manifold 60, also mounted to the frame of the printer 30. The vacuum manifold 60 applies a partial vacuum through the line 58. It is not contemplated that the vacuum must be a high vacuum or even that attained with a mechanical forepump. Instead, it is preferred that the vacuum manifold be pumped to a pressure of about 1–8 psia (pounds per square inch, absolute) by an appropriate pump, such as a syringe or peristaltic pump, which are inexpensive. Most preferably, the pressure is about 1–3 psia. In the illustrated preferred embodiment, a plunger 62 is retracted within the body of a syringe 64 by a linearly acting motor 66, drawing a vacuum within the body of the syringe 64 and thence in the vacuum line 58. Alternatively, another type of structure that produces the required motion, such as a gear arrangement operating from the linear movement of the carriage 40, would be operable.

The print head assembly 10 is moved into position just below and adjacent the valve 52 of the service station 50, when refilling of the container 14 is required. A support 70 having an compliant seal 72, such as a nonabsorbing piece of urethane, is raised up against the underside of the print head assembly 10, and specifically the ejector 12, by a pair of cams 74 on cam shafts 76. The seal 72 prevents leakage of colorant from the ejector 12, and permits a vacuum to be drawn on the interior of the reservoir container 14, during refilling. Rotation of the cam shafts 76 occurs under control of a motor such as the carriage traverse motor or the paper advance motor, or a trip arrangement when the print head assembly 10 enters the service station 50.

The slight upward movement of the print head assembly 10 induced by the support 70 causes the upper surface of the print head assembly 10 to contact the valve 52. More specifically, in the position of contact, the vacuum port 24 of the container portion of the print head assembly 10 is within the periphery of an annular rubber seal 78 affixed to the underside of the valve 52, that seals against vacuum leakage. This permits a vacuum to be drawn on the interior of the reservoir container 14 through the port 24. The seal need not be extraordinarily tight as might be required for high vacuum systems, but must be sufficient to permit a vacuum to be drawn during the refilling operation.

The upper end of the refill needle 26 is flared outwardly to form a colorant flow port 80, which communicatingly contacts the underside of the valve 52, so that colorant may flow from the colorant supply bottle 56 through the line 54 and the valve 52, and thence into the interior of the reservoir container 14. After completion of the filling operation, the camshafts 76 are rotated to lower the print head assembly 10 out of contact with the valve 52, and the print head assembly 10 can be moved back to the printing position over the printing medium.

The mode of operation of the service station 50 is illustrated in FIG. 6. The valve 52 can be of any acceptable form, such as a rotary valve, a slide valve, or otherwise. In the embodiment illustrated in FIG. 6, the valve is a three-position slide valve having elements that can be operated as required to accomplish the refilling operation. An acceptable valve of this type can be molded from plastic or purchased from a commercial supply house such as Cole-Parmer. (A two position rotary valve is illustrated in FIG. 7, and will be discussed subsequently.)

Figure 6A:
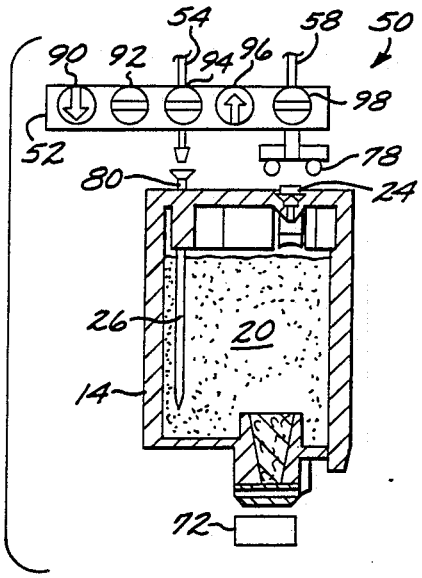
FIG. 6 A, B and C is a three part diagrammatic view of the refilling operation using the present approach and a three-position slide valve, showing (A) the relative relationship of the print head and the service station prior to the refilling operation, (B) the relationship of the print head, the service station, and the valve when a vacuum is applied to the container, and (C) the relationship of the print head, service station, and the valve as colorant flows from the colorant supply to the reservoir container.
Figure 7:
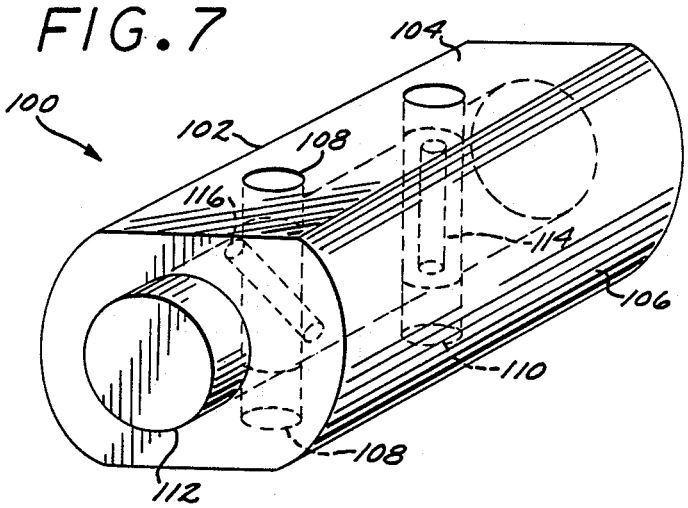
FIG. 7 is a perspective view of a two-position rotary valve that may be used in the refilling operation.

Referring to FIG. 6A, the relationship of the print head assembly 10 and the valve 52 is shown before and after the refilling operation. The print head assembly 10 does not contact any part of the valve 52. From left to right in the view of FIG. 6A, the valve mechanism includes a downward flow path 90, a closed element 92 where nothing flows, a second closed element 94 where nothing flows, an upward flow path 96, and a third closed element 98. In the view of FIG. 6A, the internal connections within the valve 52 to the colorant supply line 54 and the vacuum supply line 58 are such that these lines are closed by the second closed element 94 and the third closed element 98, respectively.

Figure 6B:
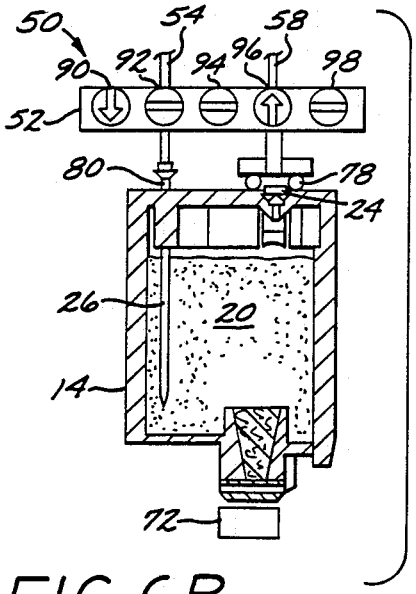

After the cam system is operated to force the seal 72 upwardly so that the print head assembly 10 contacts the valve 52 in the manner previously discussed, the valve 52 is operated as illustrated in FIG. 6B so that the colorant supply line 54 is closed by the first closed element 92, but the vacuum line 58 is connected to the interior of the reservoir container 14 through the upward flow path 96. That is, a vacuum is drawn on the interior of the reservoir container 14 along the communicating passage from the vacuum manifold 60 through the line 58, the upward flow path 96, and the vacuum port 24 (sealed against gas loss by the seal 78). No colorant flows into the container because the line 54 is sealed.

Figure 6C:
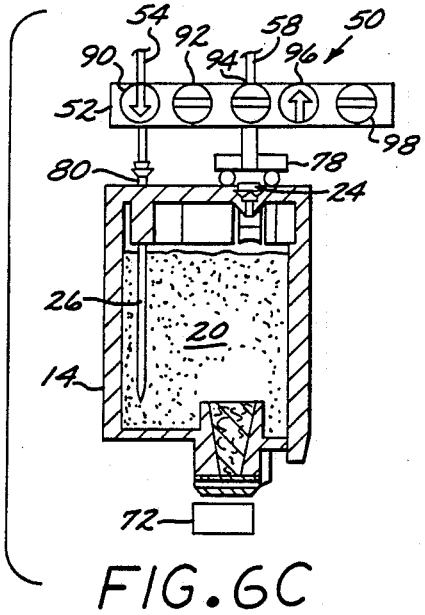

Once a partial vacuum is drawn on the interior of the reservoir container 14, the valve 52 is again operated, to the position indicated in FIG. 6C. The vacuum line 58 and the port 24 are sealed by the second closed element 94. The colorant supply line 54 is connected to the refill needle 26 through the downward flow path 90. Colorant is drawn into the interior of the container 14 by the differential pressure of the vacuum previously created in the interior of the container 14. The colorant flows from the colorant supply 56, which is vented to atmospheric pressure, through the colorant supply line 54, the downward flow path 90, the needle 26, and into the body of the foam 20 within the reservoir container 14, gradually saturating the foam with colorant.

An alternative two-position rotary valve 100 is shown in FIG. 7. This valve 100 is preferably used where a vacuum is not constantly maintained, but is created only when required. The vacuum manifold 60 therefore need not be sealed between refilling cycles, as was described for the slide valve approach in FIG. 6(C). The valve 100 includes a hollow cylindrical valve body 102 with an upper sealing surface 104 and a lower sealing surface 106. Bores 108 and 110 are formed through the valve body 102 in the proper locations to connect the colorant supply line 54 to the colorant flow port 80, and the vacuum line 58 to the vacuum port 24, respectively. A rotatable valve core 112 extends through the valve body 102. The core 112 has two flow path passages diametrically therethrough, a first passage 114 adjacent the bore 110, and a second passage 116 adjacent the bore 108. The passages are circumferentially displaced from each other. In a first rotational position, the passage 114 connects the vacuum line 58 to the vacuum port 24, through the bore 110. In a second rotational position, the passage 116 is aligned to connect the colorant supply line 54 to the colorant flow port 80 through the bore 108. These two rotational positions are sufficient to provide the colorant and vacuum connections, when required. The valve may be operated to a third rotational position of the core 112, where there is no communicating connection between the colorant supply line 54 and the colorant flow port 80, or between the vacuum line 58 and the vacuum port 24. Both the colorant flow and vacuum are therefore closed off. The valve 100 can therefore be operated to achieve the same results as a three position valve, except by rotational rather than sliding movement.

When the reservoir container 14 is filled at the factory with colorant, prior to shipment to the customer, the precise amount of colorant to supply is known, and can be provided exactly. If, however, the reservoir container is to be refilled in the field, after operation, it is not known exactly how much colorant has been ejected, and care must be taken to ensure that too much colorant is not added so that the reservoir container would overfill and leak. The present approach is self-regulating, because it is not possible to overfill the reservoir container 14. As the colorant is permitted to flow into the reservoir container in the portion of the refilling process discussed in conjunction with FIG. 6C, the vacuum level falls (or alternatively, the pressure, which is below atmospheric, rises toward atmospheric pressure). Since the colorant supply bottle is vented to atmospheric pressure, the driving force for colorant flow is the pressure difference between one atmosphere and the current pressure within the container. When that pressure reaches approximately one atmosphere, which it must prior to complete refilling of the reservoir container 14, the flow of colorant ceases because the driving force disappears. In practice, the colorant flow ceases prior to the point where the pressures balance, because of fluid friction in the line, differences in elevation, or intentional closing of the valve before the flow has stopped. In any event, overfilling is impossible.

The reservoir container 14 will not fill completely with this refilling approach, but the refilling operation may be repeated sufficiently often that there is no chance that the reservoir container 14 will run dry. The present approach is self-regulating also in the sense that, where multiple print heads are used, as in the case of color printers, each print head can be individually refilled automatically from its own individual colorant supply, but using the same vacuum level, so that the level of colorant in the multiple print heads tends to remain roughly equal over time even where the print heads consistently eject different amounts of colorant.

Figure 8:
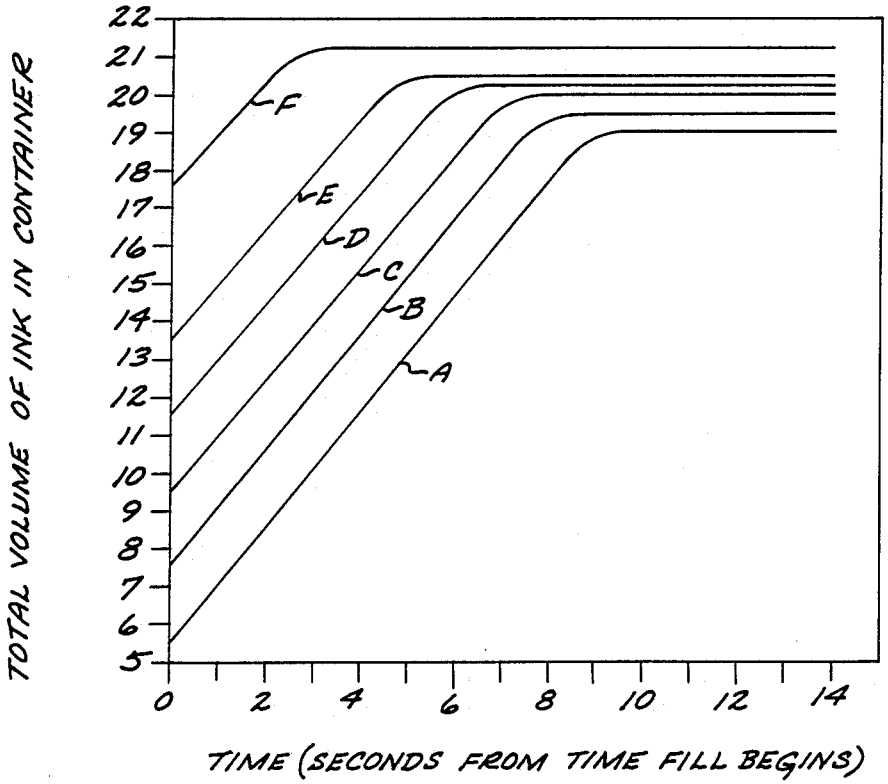
FIG. 8 is a graph illustrating the colorant level during refilling of the reservoir container.

FIG. 8 graphically illustrates the refilling of the reservoir container 14. FIG. 8 presents the results of a computer simulation of reservoir container refilling for particular reservoir container size and vacuum conditions, but with differing initial colorant levels in the reservoir container at the beginning of refilling. In this simulation, the volume of the pen was 22 cc (cubic centimeters), and the vacuum drawn on the interior of the container was 2.0 psia. For curve A, the container had only about 5.5 cc of colorant before refilling commenced (time equals 0), but reached a volume of 19 cc after 12 seconds. For curve F, the container had about 17.5 cc of colorant before refilling commenced, but reached a volume of 21 cc after 2 seconds. Intermediate curves B–E illustrate intermediate initial volumes of colorant prior to refilling. Although the vacuum-driven refilling varied as to the time required to reach the maximum refill level in each case, in all cases the final volume of colorant after refilling was 20 +/− 1 cc. It is not possible for the container to be overfilled. In normal practice, the level of colorant in the container would not be permitted to fall to the 5 cc level. Instead, the printer would be programmed to initiate refilling after normal usage reduced the colorant level to about 10 cc. The rate of refilling and the volume after refilling is dependent upon the vacuum level attained during the refilling operation. In color ink jet systems where there are multiple pens and reservoir containers, the levelling effect illustrated in FIG. 8, wherein the final colorant volume is approximately the same regardless of the volume of colorant in a reservoir prior to refilling, tends to equalize the amount of colorant in each of the reservoir containers, even where there has been unequal usage of colorant prior to refilling.

The present invention provides an inexpensive but reliable approach to refilling ink jet print heads during service. The refilling is accomplished automatically, without the need for operator attention and also without the need for a complex control system. Although a particular embodiment of the invention has been described in detail for purposes of illustration, various modifications may be made without departing from the spirit and scope of the invention. Accordingly, the invention is not to be limited except as by the appended claims.

What is claimed is:

1. An ink jet printer, comprising:

print head means for ejecting droplets of a colorant, including a reservoir container that holds a volume of the colorant, a colorant ejector in communication with the reservoir container that receives a flow of colorant from the reservoir container and ejects droplets of colorant therefrom under command, a vacuum port in the wall of the reservoir container, and refill tube means for refilling the reservoir, the refill tube means communicating from the exterior of the reservoir container into the interior of the reservoir container; and a service station for adding colorant to the reservoir container, including a colorant supply, a vacuum manifold, valve means for controllably placing the vacuum manifold in communication with the vacuum port and sealing the colorant supply from the refill tube means in a first refilling position, and for controllably sealing the vacuum manifold from communication with the vacuum port and placing the colorant supply in communication with the refill tube means in a second refilling position, and support means for holding the reservoir container in contact with the valve means, for preventing ejection of colorant, and for preventing introduction of air into the print head.

2. The ink jet printer of claim 1, wherein the reservoir container is at least partially refilled with a colorant-retaining foam mass.

3. The ink jet printer of claim 1, wherein the vacuum manifold includes a vacuum pump.

4. The ink jet printer of claim 3, wherein the vacuum pump is a piston pump.

5. The ink jet printer of claim 1, wherein the valve means includes a three-position valve having a first position wherein both the vacuum manifold and the colorant supply are sealed from communication with the interior of the reservoir container, a second position wherein the vacuum manifold is placed in communication with the vacuum port and the colorant supply is sealed from communication with the refill tube means, and a third position wherein the vacuum manifold is sealed from communication with the vacuum port and the colorant supply is placed in communication with the refill tube means.

6. The ink jet printer of claim 1, wherein the valve means includes a two-position valve having a first position wherein the vacuum manifold is placed in communication with the vacuum port and the colorant supply is sealed from communication with the refill tube means, and a second position wherein the vacuum manifold is sealed from communication with the vacuum port and the colorant supply is placed in communication with the refill tube means.

7. The ink jet printer of claim 1, wherein the valve means includes a rotary valve.

8. The ink jet printer of claim 1, wherein the valve means includes a slide valve.

9. An ink jet printer operable with print head means for ejecting droplets of a colorant, the print head means including a reservoir container that holds a volume of the colorant, an ink ejector that receives colorant from the reservoir container and ejects droplets of colorant therefrom, and a refill tube extending from the exterior of the reservoir container into the interior of the reservoir container, the printer comprising:

a service station whereat colorant is added to the reservoir container, including a colorant supply, a vacuum manifold, valve means for controllably placing the vacuum manifold in communication with the interior of the reservoir container and sealing the colorant supply from the refill tube in a first refilling position, and for controllably sealing the vacuum manifold from communication with the reservoir container and placing the colorant supply in communication with the refill tube in a second refilling position, and support means for holding the reservoir container in contact with the valve means, for preventing ejection of colorant, and for preventing introduction of air into the print head.

10. The ink jet printer of claim 9, wherein the valve means includes a three-position valve having a first position wherein both the vacuum manifold and the colorant supply are sealed from communication with the interior of the reservoir container, a second position wherein the vacuum manifold is placed in communication with the vacuum port and the colorant supply is sealed from communication with the refill tube means, and a third position wherein the vacuum manifold is sealed from communication with the vacuum port and the colorant supply is placed in communication with the refill tube means.

11. The ink jet printer of claim 9, wherein the valve means includes a two-position valve having a first position wherein the vacuum manifold is placed in communication with the vacuum port and the colorant supply is sealed from communication with the refill tube means, and a second position wherein the vacuum manifold is sealed from communication with the vacuum port and the colorant supply is placed in communication with the refill tube means.

12. The ink jet printer of claim 9, wherein the valve means includes a rotary valve.

13. The ink jet printer of claim 9, wherein the valve means includes a slide valve.

14. The ink jet printer of claim 9, wherein the vacuum manifold includes a vacuum pump.

15. The ink jet printer of claim 14, wherein the vacuum pump is a piston pump.

16. An ink jet print head, comprising:

a reservoir container having a foam mass and adapted for holding a supply of the colorant, the reservoir container having no instrumentation therein for measuring liquid level within the container;

an ink ejector that receives colorant from the reservoir container and ejects colorant therefrom;

a vacuum port in the wall of the reservoir container; and a refill tube inserted from the exterior of the reservoir container into the foam mass within the reservoir container, whereby the vacuum port and the refill tube cooperate to permit refilling of the reservoir container without overfilling, and without requiring any level-measuring instrumentation within the container.

17. A process for adding colorant to the print head of an ink jet printer, comprising the steps of:

furnishing a colorant reservoir container;

creating a partial vacuum in the interior of the reservoir container using a vacuum manifold;

sealing the interior of the reservoir container from the vacuum manifold: and, after the step of sealing, placing the interior of the reservoir container into fluid communication with a supply of the colorant and permitting colorant to be drawn into the interior of the reservoir container by the partial vacuum created in the step of creating.

18. An ink jet print head, comprising:

a reservoir container having a foam mass and adapted for holding a supply of a colorant, the reservoir container having no instrumentation therein for measuring liquid level within the container;

an ink ejector that receives colorant from the reservoir container and ejects colorant therefrom; and a refill port in the wall of the reservoir container, the refill port being adapted to permit the reservoir to be refilled with colorant without requiring instrumentation to monitor the toner level within the container.

19. The print head of claim 18, further including a refill tube extending from the refill port into the foam mass within the interior of the reservoir container.

20. The print head of claim 19, further including a vacuum port in the wall of the reservoir container.

* * * * *